US006038909A

United States Patent [19]

Zink

[11] Patent Number: 6,038,909

[45] Date of Patent: Mar. 21, 2000

[54] PORTABLE SHEET METAL BRAKE

[76] Inventor: Joe M. Zink, 5631 Hursh Rd., Fort Wayne, Ind. 46845

[21] Appl. No.: 09/118,648

[22] Filed: Jul. 17, 1998

[51] Int. Cl.[7] ..... B21D 5/04

[52] U.S. Cl. ..... 72/319

[58] Field of Search ..... 72/319–321, 387, 72/388, 446, 448

[56] References Cited

U.S. PATENT DOCUMENTS

| | | | |
|---|---|---|---|
| 134,376 | 12/1872 | Gorton . | |
| 505,567 | 9/1893 | Douglass | 72/319 |
| 1,030,259 | 6/1912 | Wells . | |
| 1,785,537 | 12/1930 | Stevens . | |
| 2,217,378 | 10/1940 | Nilsby . | |
| 2,602,358 | 7/1952 | Lile . | |
| 2,687,162 | 8/1954 | Smith . | |
| 3,129,938 | 4/1964 | Riley . | |
| 3,161,223 | 12/1964 | Marsh . | |
| 3,482,427 | 12/1969 | Barnack . | |
| 3,559,444 | 2/1971 | Blazey et al. . | |
| 3,817,075 | 6/1974 | Marsh et al. . | |
| 3,943,744 | 3/1976 | Marsh | 72/446 |
| 4,240,279 | 12/1980 | Rhoades . | |
| 4,321,817 | 3/1982 | Barnack . | |
| 4,372,142 | 2/1983 | Rhoades . | |
| 4,445,356 | 5/1984 | Chubb et al. . | |
| 4,489,583 | 12/1984 | Rhoades . | |
| 4,493,200 | 1/1985 | Rhoades . | |
| 4,494,397 | 1/1985 | Rhoades . | |
| 5,228,325 | 7/1993 | Wiebe | 72/446 |

FOREIGN PATENT DOCUMENTS

| | | | |
|---|---|---|---|
| 288029 | 10/1915 | Germany | 72/320 |
| 328513 | 4/1958 | Switzerland | 72/320 |

*Primary Examiner*—Daniel C. Crane
*Attorney, Agent, or Firm*—Randall J. Knuth

[57] ABSTRACT

A sheet bending brake includes a bending member pivotingly associated with the fixed jaw and configurable therewith in at least one of a clamping and pressing arrangement. The bending member includes semicircular-shaped projecting flange elements that are adjustably positioned within respective complementary grooves formed in the fixed jaw. The movable upper jaw and fixed lower jaw are rotatingly adjustably secured to the "C"-shaped frame member, permitting the frame and jaw assemblies to be reconfigured in various relative orientations to thereby adapt the brake to front feed, end feed, and rear feed applications.

46 Claims, 7 Drawing Sheets

PORTABLE SHEET METAL BRAKE

BACKGROUND OF THE INVENTION

1. Field of the Invention

The present invention relates to hand-held sheet metal brakes and, more particularly, to a portable brake system enabling the jaw assemblies to be rotationally repositioned relative to the frame member and which incorporates a hinged a bending member having pivot elements that do not intrude into the working space of the brake system.

2. Description of the Related Art

Conventional brakes typically consist of a fixed lower jaw, a movable upper jaw secured to a "C"-shaped member, and a hinged movable member or apron attached to the fixed lower jaw. A disadvantage found with various conventional hinges involves their orientation with respect to the working space, notably in the fact that the hinge structures protrude above the plane of the fixed lower jaw and the "at-rest" hinged member. This protruding characteristic serves as an obstacle to and typically prevents the feeding of material from the end of the brake.

It is common for brakes, especially lightweight portable brakes built for the siding industry, to include a pair of base rails on which the "C"-shaped members are positioned at longitudinally-spaced intervals. A first member is fixed on the lower arms of the "C"-shaped member and has a clamping surface. A second member having a bending surface is hinged (usually a piano-type) to the first member. An anvil member is provided over the clamping surface and an upper movable jaw is secured between the anvil and the upper arms of the "C"-shaped member. The "C"-shaped member and piano-type hinge allow material that is wider than the brake itself to be worked since it can extend laterally with no impedance from the hinge pins. However, the longitudinally-spaced "C"-shaped members prevent material from being fed from the rear of the brake, except through the space between adjacent ones of the "C"-shaped members. Additionally, this brake configuration does not permit material, particularly preformed material such as ducts and pipes commonly used in the heating, air conditioning and ventilation (HVAC) industry, to be fed into the brake from the end.

There is a current need for equipment in the HVAC industry that can rework existing ductwork at the job site. This task is usually undertaken with hand seamers, which are a plier-like device with two flat plates designed to clamp onto the sheet metal after which a bend is made with an upward or downward motion of the wrist. These bends have disadvantageous rounded corners, especially when working with the heavier gauges of sheet steel. Additionally, the hand seamers typically are limited to approximately six inches in working width and therefore the sheet metal must be sectionally worked in piece-wise fashion across the front edge of the metal piece in six inch increments, such that partial bends are made on the first pass and the remaining bends are made on the second pass. This iterative bending process is clearly time consuming and introduces a degree of inexactness into the process since each bending iteration might not be exactly reproducible relative to the other bends.

SUMMARY OF THE INVENTION

According to the present invention there is provided a sheet metal brake incorporating a bending member pivotally associated with the fixed jaw and configurable therewith in at least one of a clamping arrangement and pressing arrangement. The bending member includes arc-shaped projecting flange elements that are adjustably positioned within respective complementary grooves formed in the fixed jaw. The flange elements are preferably provided in the form of semicircular structures interfittingly registered to correspondingly shaped grooves in the fixed jaw. In accordance with another aspect of the present invention, the movable upper jaw and fixed lower jaw are rotatingly adjustably secured to the frame, which is preferably provided in the form of a generally "C"shaped member. Consequently, the movable upper jaw and fixed lower jaw are independently rotatable with respect to the frame, permitting the frame and jaw assemblies to be reconfigured in various relative orientations to thereby adapt the brake system to front feed, lateral feed, and rear feed applications.

The invention comprises, in one form thereof, a sheet bending brake including a frame; a fixed jaw rotatingly adjustably coupled to the frame at one portion thereof; a movable jaw rotatingly adjustably coupled to the frame at another portion thereof, the movable jaw being movable relative to the fixed jaw in at least one of a clamping and non-clamping arrangement therewith; an anvil member secured to the movable jaw; and a bending member hingedly associated with the fixed jaw.

The bending member further includes, in one form thereof, at least two hinging projections each adjustably received within a respective complementary channel integrally associated with the fixed jaw. The hinging projections are characterized in a non-pivoting condition of the bending member such that no part thereof extends above a clamping plane defined at an upper surface of the fixed jaw. Each of the hinging projections further includes, in one form thereof, a structure defining, at least in part, an arc shape having a substantially semicircular portion. Likewise, each of the complementary channels associated with the fixed jaw defines, at least in part, a substantially semicircular portion.

The bending member, in a preferred form thereof, is configurable with the fixed jaw in a sheet bending arrangement when at least two hinging projections are adjustably disposed within first ends of the complementary channels associated with the fixed jaw, and is configurable with the fixed jaw in a sheet pressing arrangement when at least two hinging projections are adjustably disposed within second ends of the complementary channels associated with the fixed jaw.

The frame includes, in one form thereof, an upper arm and a lower arm in spaced-apart relation, and a connecting body connected at respective ends thereof to the upper arm and the lower arm. There is further provided a socket member integrally associated with the upper arm and extending towards the lower arm, and a cylindrical hub integrally associated with the movable jaw and rotatingly adjustably disposed within the socket member integrally associated with the upper arm and secured therein using a removable pin. There is additionally provided a cylindrical hub integrally associated with the lower arm and extending towards the upper arm, and a socket member integrally associated with the fixed jaw and rotatingly adjustably disposed about the cylindrical hub integrally associated with the lower arm and secured thereabout using a removable pin.

The sheet bending brake further includes, in one form thereof, a rocker link pivotingly coupled at one end thereof to the movable jaw; and an actuator means, pivotingly coupled to the rocker link at another end thereof, for inducing a pivoting action of the rocker link to effect movement of the movable jaw. The actuator means, in one form thereof, includes a lever member having a pair of spaced-apart extending link arms, the pair of extending link arms defining at one end thereof the fulcrum point for the lever member and defining at another end thereof a pivoting connection with the rocker link. The arrangement of the connecting body, the upper arm, and the lower arm of the frame preferably defines a generally C-shaped structure.

The invention comprises, in another form thereof, a sheet bending brake including a frame; a first jaw assembly integrally associated with the frame and being adapted to enable rotational adjustments to the relative positioning therebetween; a second jaw assembly integrally associated with the frame and being adapted to enable rotational adjustments to the relative positioning therebetween, the second jaw assembly including a movable jaw member being controllably movable with respect to the first jaw assembly; an anvil member secured to the movable jaw member; and a bending member arranged for adjustable pivoting with respect to the first jaw assembly.

The bending member further includes, in one form thereof, at least two projection elements each extending from a body of the bending member and being adjustably positioned within a respective complementary channel provided in the first jaw assembly. Each of the at least two projection elements of the bending member includes, in one form thereof, a substantially semicircular portion. Each of the complementary channels provided in the first jaw assembly likewise includes a substantially semicircular portion. When the bending member is arranged in a non-pivoting orientation with respect to the first jaw assembly, the at least two projection elements of the bending member are characterized such that no part thereof extends above a clamping plane defined by the first jaw assembly.

The first jaw assembly further includes, in one form thereof, a socket member rotatingly adjustably disposed about a cylindrical hub integrally associated with the frame. The second jaw assembly further includes, in one form thereof, a cylindrical hub rotatingly adjustably disposed within a socket member integrally associated with the frame. The second jaw assembly is further provided with a rocker link pivotingly coupled at one end thereof to the movable jaw member; and means, pivotingly coupled to the rocker link at another end thereof, for inducing a pivoting action of the rocker link effective in moving the movable jaw member. Such means includes, in one form thereof, a lever member having a pair of spaced-apart extending link sections, the pair of extending link sections defining at one end thereof the fulcrum point for the lever member and defining at another end thereof a pivoting connection with the rocker link.

The invention comprises, in yet another form thereof, a sheet bending brake comprising a frame; a fixed jaw rotatingly adjustably secured to the frame; a movable jaw rotatingly adjustably secured to the frame, the movable jaw being controllably movable with respect to the fixed jaw; an anvil member secured to the movable jaw; and a bending member pivotingly associated with the fixed jaw, wherein the bending member includes at least two projecting flange elements each adjustably disposed within a respective complementary channel integrally associated with the fixed jaw.

Each of the at least two projecting flange elements includes, in one form thereof, a curvilinear portion defining, at least in part, a substantially semicircular shape. Each of the complementary channels integrally associated with the fixed jaw likewise includes a curvilinear portion defining, at least in part, a substantially semicircular shape.

The frame further includes, in one form thereof, a generally C-shaped structure including an upper arm, a lower arm in spaced-apart relation to the upper arm, and a connecting body connected at respective ends thereof to the upper arm and the lower arm. A socket member is integrally associated with the upper arm and extends towards the lower arm. A cylindrical hub is integrally associated with the movable jaw and is rotatingly adjustably disposed within the socket member integrally associated with the upper arm. There is also provided a cylindrical hub integrally associated with the lower arm and extending towards the upper arm; and a socket member integrally associated with the fixed jaw and rotatingly adjustably disposed about the cylindrical hub integrally associated with the lower arm.

A rocker link is pivotingly coupled at one end thereof to the movable jaw. A lever mechanism is provided having a pair of spaced-apart extending link arms. The pair of extending link arms defines at one end thereof the fulcrum point for the lever mechanism and defines at another end thereof a pivoting connection with the rocker link.

When the bending member is oriented in a non-pivoting condition with respect to the fixed jaw, in accordance with one aspect thereof, at least two projecting flange elements are characterized such that no part thereof extends above a clamping plane defined by the fixed jaw. Additionally, the bending member is configurable with the fixed jaw in a sheet bending arrangement when the at least two projecting flange elements thereof are adjustably disposed within first ends of the complementary channels integrally associated with the fixed jaw. The bending member is also configurable with the fixed jaw in a sheet pressing arrangement when the at least two projecting flange elements thereof are adjustably disposed within second ends of the complementary channels integrally associated with the fixed jaw.

The invention comprises, in yet another form thereof, a sheet bending brake comprising a frame, a fixed jaw integrally associated with the frame, a movable jaw integrally associated with the frame and controllably movable relative to the fixed jaw, and an anvil member secured to the movable jaw. The sheet bending brake further includes a bending member pivotingly associated with the fixed jaw; wherein the bending member includes at least two projecting flange elements each adjustably disposed within a respective complementary channel integrally associated with the fixed jaw.

Each of the at least two projecting flange elements includes a curvilinear portion defining, at least in part, a substantially semicircular shape. Each of the complementary channels integrally associated with the fixed jaw includes a curvilinear portion defining, at least in part, a substantially semicircular shape. When the bending member is oriented in a non-pivoting condition with respect to the fixed jaw, the at least two projecting flange elements are characterized such that no part thereof extends above a clamping plane defined by the fixed jaw.

The fixed jaw and movable jaw, in a preferred form thereof, are rotatingly adjustably secured to the frame at respective portions thereof.

It is one advantage of the present invention to provide a sheet bending brake enabling adjustable repositioning of the jaw assemblies relative to the integral "C"-shaped frame member, thereby expanding the field of use to include front feed, back feed, and end feed applications.

It is another advantage of the present invention to provide a brake incorporating an arc-type hinge that serves as the pivoting connection between the fixed jaw and bending member and which is designed such that no part of the hinge element extends into either the clamping plane or the bending plane during the "at-rest" positioning of the bending member.

It is another advantage of the present invention to provide such an arc-type hinge that enables a flush registered alignment of the clamping plane to the bending plane, thereby creating a free, intact working plane for receiving the sheet material without any impedance.

It is another advantage of the present invention to provide a bending member with such an arc-type hinge that is configurable in either a sheet-pressing arrangement or a sheet-bending arrangement by alternating the point of entry of the hinge elements with respect to their complementary guiding channels.

It is another advantage of the present invention to provide a brake having the versatility to accommodate cooperative working arrangements with other equipment ranging from hand seamers to lightweight portable brakes.

It is another advantage of the present invention to provide a brake having the adaptability to be reconfigured in a manner that enables the brake to be applied to a variety of workpiece structures such as preformed ductwork (e.g., tubes or boxes), which are otherwise inaccessible when using the jaw arrangements of conventional brakes.

It is another advantage of the present invention to provide such an adaptable brake in which the relative positioning of the jaw assemblies and "C"-shaped frame can be rotatingly adjustable modified to conform to the structure of interest, for example a tube that now becomes accessible by rotating the jaw assemblies to permit positioning of the tube section into the clamping space.

It is another advantage of the present invention to provide such an adaptable brake having the portability to be carried in a tool box and which is characterized by comparatively easier handling and storage.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein:

FIG. 6 is an upper planar schematic view of the bending member according to the present invention, illustrating the extension of the projecting flange elements;

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
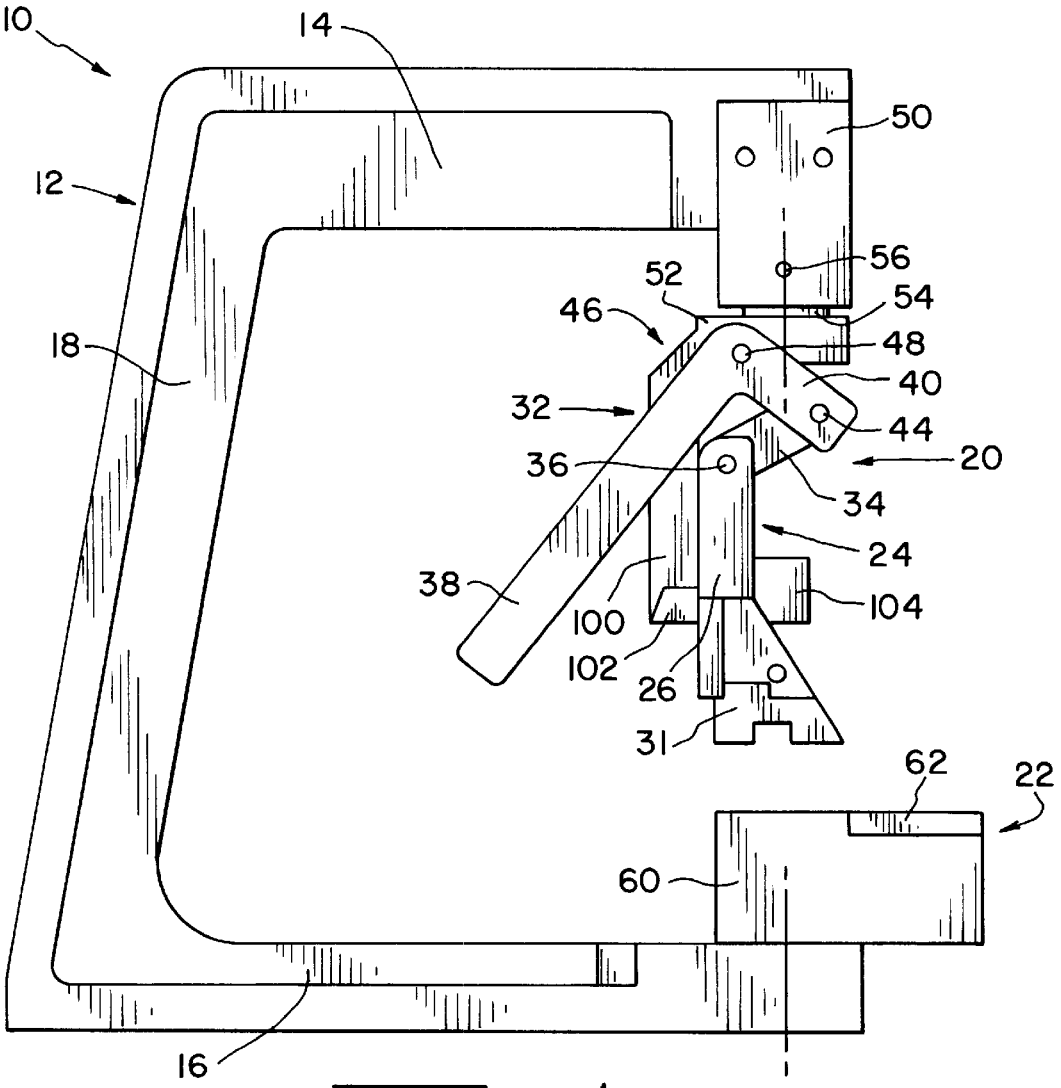
FIG. 1 is a lateral schematic view of a brake system according to one embodiment of the present invention as configured in a pre-clamping state with the anvil raised.
Figure 2:
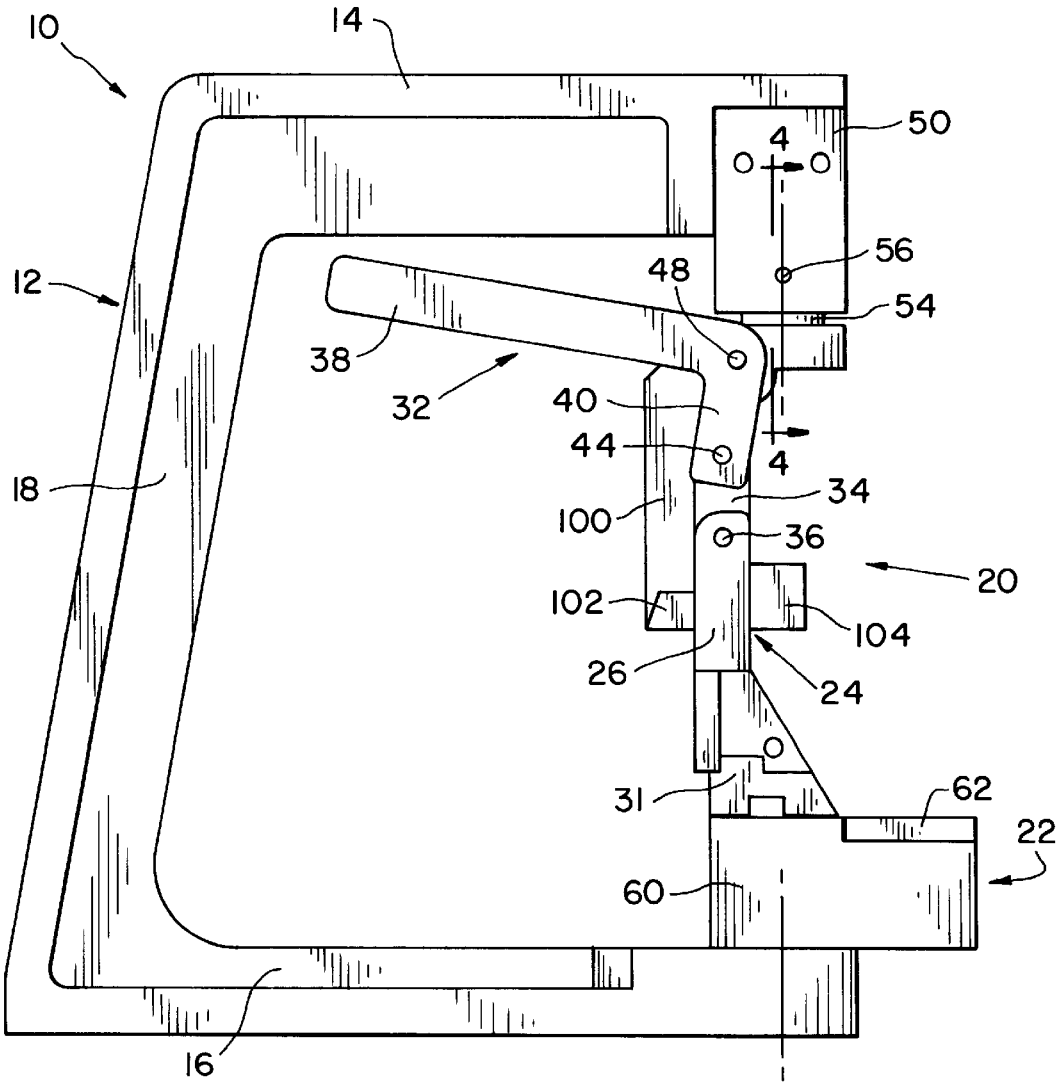
FIG. 2 is a lateral schematic view of the brake system of FIG. 1 as configured in a clamping state with the anvil lowered.
Figure 3:
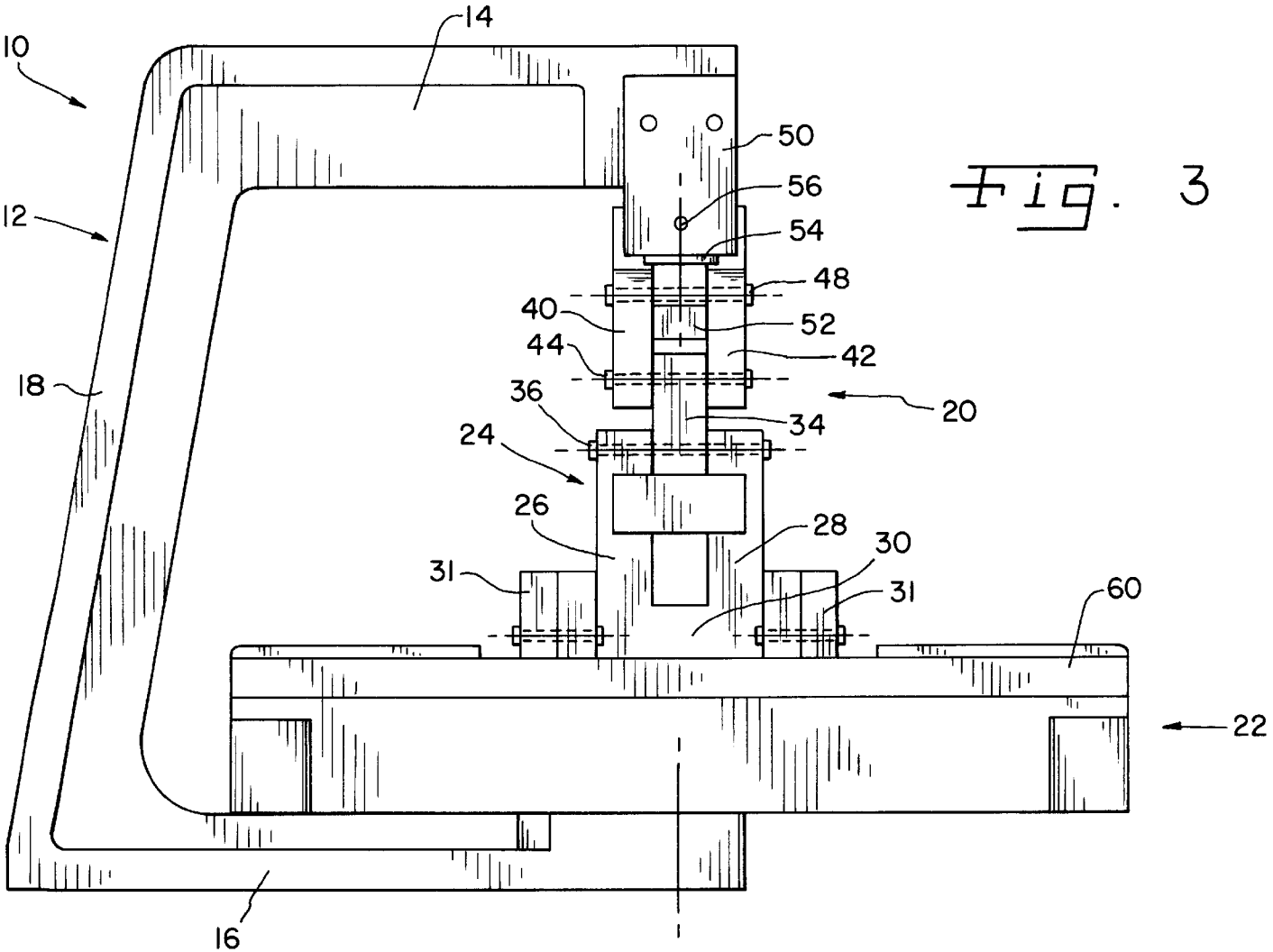
FIG. 3 is a schematic view of the brake system as shown in FIG. 2 illustrating in a frontal perspective the arrangement of jaw assemblies after undergoing a 90 degree rotation relative to the FIG. 2 orientation, in accordance with one aspect of the present invention.

Referring now to the drawings, and particularly to FIGS. 1–3, there is shown a series of views of sheet bending brake 10 according to the present invention illustrating the orientation of the jaw assemblies in various feed positions and clamping conditions. FIGS. 1 and 2 show lateral views of brake 10 with the jaw assemblies arranged in a front feed configuration and with the anvil respectively raised in a pre-clamping position and lowered in a clamping position. FIG. 3 shows a lateral view of brake 10 in a clamping condition with the jaw assemblies rotated from their orientation of FIGS. 1 and 2 so as to be arranged in an end feed configuration.

The illustrated brake 10 includes a support structure or frame generally indicated at 12 provided in the form of a generally "C"-shaped member having an upper arm 14, a lower arm 16 disposed in spaced-apart relation to upper arm 14, and a connecting body 18 interposed between and connecting upper arm 14 with lower arm 16 at ends thereof. The "C"-shaped member 12 is constructed for ease of handling and represents the part that an operator grasps while carrying brake 10 or securely grips to add a stabilizing firmhold during the time the jaw assemblies are in a working state. Brake 10 further includes an upper jaw assembly generally indicated at 20 that is rotatingly adjustable secured to "C"-shaped member 12 at the free end of upper arm 14. Brake 10 further includes a lower jaw assembly generally indicated at 22 that is rotatingly adjustably secured to "C"-shaped member 12 at the free end of lower arm 16. Jaw assemblies 20 and 22 provide a conventional functionality relating to the reshaping of a workpiece when the jaw assemblies act cooperatively in a clamping arrangement such as shown in FIGS. 2 and 3. For example, the jaw assemblies 20 and 22 may be used to bend a piece of planar sheet material positioned therebetween. The rotating feature enables jaw assemblies 20 and 22 to be independently rotatable relative to "C"-shaped member 12 in order to permit their reconfiguration into other arrangements that are compatible with front feed, back feed, and end feed applications. Alternatively, the various feed positions may be attainable by rotating "C"-shaped member 12 while maintaining the jaw assemblies 20 and 22 in a stationary orientation.

The illustrated upper jaw assembly 20 includes a movable jaw member shown generally at 24 provided in the form of a generally U-shaped structure (see FIG. 3) having a pair of upstanding spaced-apart sidewall members 26 and 28 integral with a base 30. An anvil member 31 of conventional construction is fixedly secured to movable jaw 24 at a lower end thereof and forms the lowermost portion of upper jaw assembly 20. Movable jaw 24 is adapted for controllable reversible movement between a non-clamping position (FIG. 1) and a clamping position (FIG. 2) using an actuator device provided in the form of a lever mechanism shown generally at 32 articulated to an intermediate linking structure provided in the form of a lockable rocker arm 34. Rocker arm 34 is pivotingly connected to movable jaw 24 at an upper end thereof using pivot shaft or pin 36 disposed between sidewalls 26 and 28 of movable jaw 24. Pivot shaft 36 defines a pivot axis about which rocker arm 34 pivots while concurrently applying a raising or lowering influence to movable jaw 24.

The illustrated lever mechanism 32 includes a movable arm 38 provided in the form of a shaft portion integrally joined to a pair of comparatively short, spaced-apart extending link portions 40 and 42 that are pivotingly connected at the free ends thereof to rocker arm 34 using pivot shaft or pin 44 disposed between link portions 40 and 42. It is apparent then that rocker arm 34 is hingedly secured at both ends thereof and thereby capable of a dual pivoting action. The shaft portion of lever mechanism 32 forms with each of its integral extending link portions 40 and 42 an arrangement having a planar profile possessing a generally L-shaped form, although it is clear that this feature is merely illustrative and that any other suitable configuration may be used. Lever mechanism 32 is pivotingly coupled to a connecting frame section shown generally at 46 using pivot shaft or pin 48, which defines a fulcrum point about which lever mechanism 32 is pivotably supported. As discussed below in further detail, frame section 46 also serves to couple the upper jaw assembly 20 to "C"-shaped member 12 in a manner permitting rotating adjustment of upper jaw assembly 20 relative to "C"-shaped member 12. As will also be discussed below in further detail, the elements constituting the lever mechanism 32, rocker arm 34, and movable jaw 24 are arranged in an interconnected relationship and operate in a cooperative manner whereby the rotary motion imparted in and through lever mechanism 32 is communicated (i.e., translated) by the intermediately-connected rocker arm 34 into reversible linear motion of movable jaw 24 and the attached anvil 31. Rocker arm 34 may therefore be considered, in one aspect thereof, as performing a cam function in regard to the manner of its usage in transforming rotary motion (of lever mechanism 32) into linear motion (of movable jaw 24).

Figure 4:
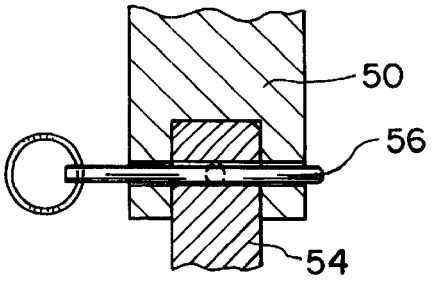
FIG. 4 is a planar fragmentary view taken in cross-section along lines 4—4 of FIG. 2, illustrating the manner of adjustably securing the upper movable jaw assembly to the support frame.

In accordance with one aspect of the present invention, upper jaw assembly 20 is adapted for adjustable rotating connection to "C"-shaped member 12 at its upper arm 14. For this purpose, there is provided a connecting structure 50 secured to upper arm 14 (e.g., with bolts) and which is provided in the form of a socket body having a generally cylindrically-shaped socket region formed at an underside thereof in opposed facing relation to upper jaw assembly 20 to facilitate access thereto. Frame section 46 includes an attachment portion 52 to which lever mechanism 32 is pivotingly connected and further includes a generally cylindrically-shaped hub portion 54 integrally associated with attachment portion 52. Socket body 50 and hub portion 54 are constructed as complementary mating structures permitting an interfit registration of hub portion 54 with socket body 50. In particular, when brake 10 is fully assembled, hub portion 54 is inserted into socket body 50 and secured therein using removable pin 56. For this purpose, hub portion 54 is provided with a slot formed therein to slidingly receive pin 56. Socket body 50 is also provided with a similar slot formed therethrough to likewise receive pin 56. Appropriate design steps are taken to ensure that the pin slot for hub portion 54 is registered in alignment with the pin slot for socket body 50 when these parts are fit together. FIG. 4 illustrates in cross-sectional view taken along lines 4—4 of FIG. 2, the manner of interfitting hub portion 54 with socket body 50 and securing this engagement with removable pin 56. Socket body 50 as a whole is provided with a series of pin slots enabling hub portion 54 to be adjustably rotated therein so as to achieve different rotational orientations of the upper jaw assembly 20 relative to "C"-shaped member 12. For example, socket body 50 could be provided with a second pin slot perpendicular to the illustrated pin slot that is now accommodating pin 56. Accordingly, such an orthogonal pair of pin slots in socket body 50 permits hub portion 54 to be arranged in one of four angular orientations about an axis of rotation passing though the slot plane. As shown, connecting frame section 46 forms with lever mechanism 32 and movable jaw 24 an integrated unit. Consequently, as hub portion 54 (which is integral with frame 46) is rotatingly repositioned within socket body 50, the effect is to likewise reposition the entire upper jaw assembly 20 into a new rotary orientation relative to "C"-shaped member 12. Executing a rotational repositioning of upper jaw assembly 20 simply involves removing pin 56, rotating jaw assembly 20 to the desired orientation (while ensuring that the pin slots are aligned), and reinserting pin 56 into the slots. It should be apparent that any number of slots may be provided in socket body 50 depending upon the number of rotary positions that are desired for jaw assembly 20. Alternatively, "C"-shaped member 12 may instead be rotatingly repositioned while jaw assembly 20 remains stationary.

Referring to lower jaw assembly 22, there is included a fixed jaw member 60 provided in integral combination with a bending member 62, in which bending member 62 is pivotingly coupled to fixed jaw member 60 using an arc-type hinge according to another aspect of the present invention. As used herein, the fixed property of fixed jaw member 60 refers to its stationary positioning relative to movable jaw 24 during the "at-work" state of brake 10, in which movable jaw 24 is vertically displaced to bring anvil 31 into engagement with a workpiece overlying fixed jaw member 60. However, in accordance with another aspect of the present invention discussed below, fixed jaw member 60 still retains an ability to be rotationally repositioned relative to "C"-shaped member 12, and consequently fixed jaw 60 may be described as a normally fixed but rotatable jaw structure.

Figure 5:
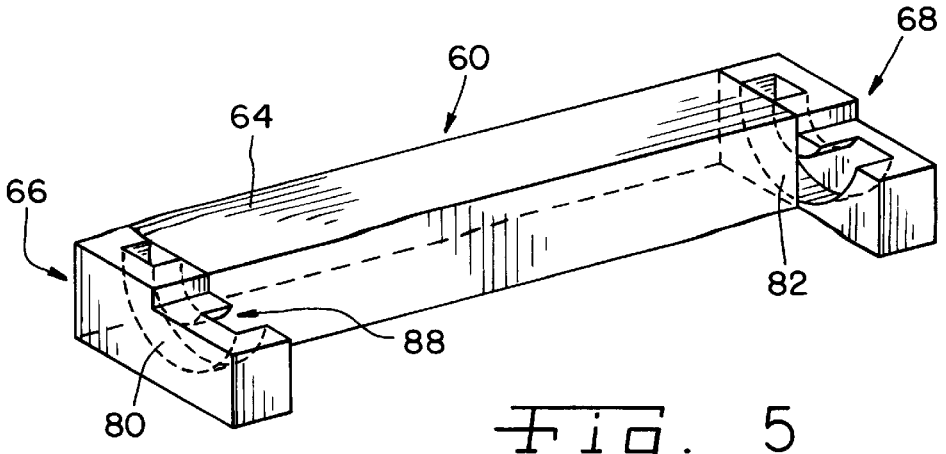
FIG. 5 is a schematic perspective view of the fixed lower jaw according to the present invention, illustrating in hidden view the arc-shaped grooves for receiving the projecting flange elements of the bending member of the present invention.

Referring to FIG. 5, fixed jaw 60 is illustratively provided in the form of an elongate body 64 of generally rectangular shape having at opposite ends thereof a pair of pivot guiding structures 66 and 68 integral therewith and which are used in cooperation with complementary mating features in bending member 62 to facilitate the hinged relationship between fixed jaw 60 and bending member 62 (discussed below in further detail). Lower jaw assembly 22 is adapted in accordance with another aspect of the present invention for relative rotation with respect to "C"-shaped member 12. For this purpose, "C"-shaped member 12 is provided in one illustrative form thereof with a cylindrically-shaped hub portion (not shown) disposed proximate the free end of lower arm 16 and which projects upwardly towards upper arm 14. Fixed jaw 60 is provided in one illustrative form thereof with a socket region (not shown) formed at the underside of elongate body 64 in a location that promotes operational stability for fixed jaw 60. The fixed jaw socket region and lower arm hub portion are constructed as complementary mating structures permitting an interfit registration therebetween. In particular, when brake 10 is fully assembled, the socket region is disposed about the hub portion in overlying relationship thereto and secured in this registered engagement using a removable pin. Fixed jaw 60 is preferably provided with a slot formed therein to slidingly receive the removable pin. Likewise, the lower arm hub portion is provided with a slot formed therethrough to receive the pin. The hub-socket arrangement in its secured condition is similar to that shown in FIG. 4. Appropriate design steps are taken to ensure that the pin slot for the hub portion is registered in alignment with the fixed jaw pin slot when these parts are fit together. The lower arm hub portion is preferably provided with at least two slots in orthogonal relationship to permit a full 360 degree range of rotational adjustment for lower jaw assembly 22. In particular, by removing the securing pin, fixed jaw 60 and its integrally associated bending member 62 may be rotationally repositioned as a single unit to another orientation relative to "C"-shaped member 12. Any number of slots maybe provided in the lower arm hub portion depending upon the number of possible rotary positions desired for jaw assembly 22.

The present invention therefore provides a means by which each of the jaw assemblies may be rotationally repositioned to change their orientation with respect to "C"-shaped member 12. Each of the jaw assemblies 20, 22 is adjustable independently of the other jaw assembly, although the repositioning of one jaw assembly is performed in concert with the other jaw assembly to ensure that their relative orientation conforms to a proper working arrangement. It is also possible to change the orientation of the jaw assemblies relative to "C"-shaped member 12 by keeping jaw assemblies 20, 22 stationary and rotating "C"-shaped member 12 relative to the stationary jaw assembly arrangement. Additionally, if the need arises, both the jaw assembly arrangement and "C"-shaped member 12 may be individually repositioned to achieve any one of various relative orientations. Accordingly, as described herein, the feature of the present invention involving the rotationally adjustable connection between the jaw assemblies 20, 22 and "C"-shaped member 12 should be understood as encompassing the facility to change their relative positioning by rotating either the jaw assembly arrangement or "C"-shaped member 12 or both.

Figure 8:
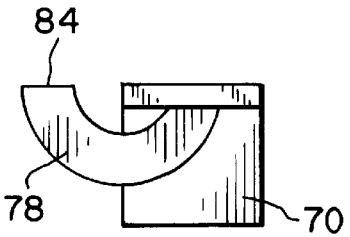
FIG. 8 is a lateral planar schematic end view of the bending member of FIG. 7 taken in the direction of lines 8—8 therein, illustrating, in full, the curvature of one of the projecting flange elements provided with the bending member.
Figure 7:
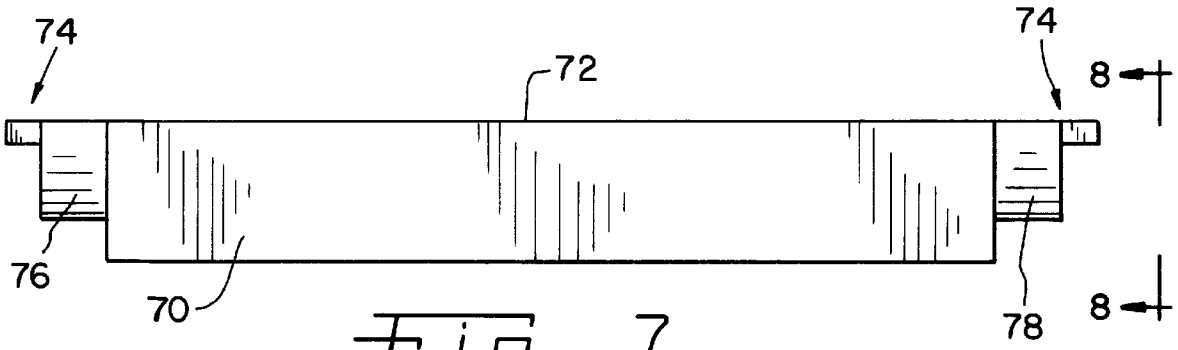
FIG. 7 is a backside planar schematic view of the bending member of FIG. 6 taken in the direction of lines 7—7 therein, illustrating the projecting flange elements in facing view thereof.
Figure 9:
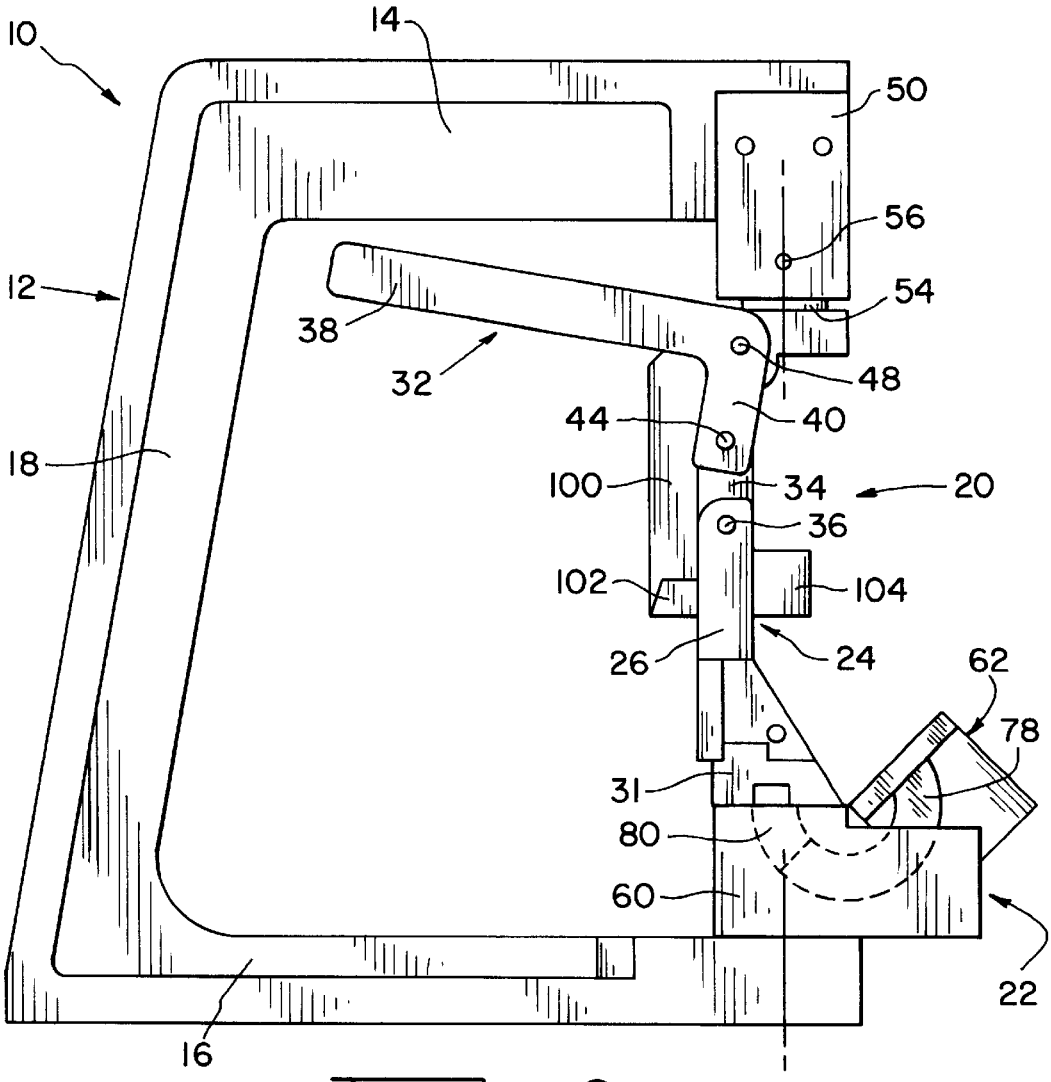
Figure 10:
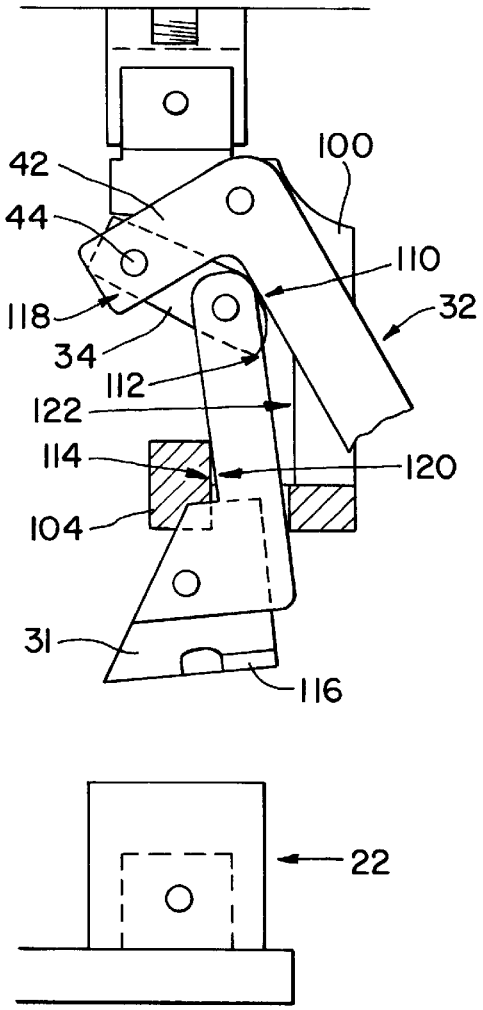
FIG. 10 is a lateral schematic view of the brake system of FIG. 1, illustrating the fully retracted position of the lever mechanism, rocker arm, and movable jaw.
Figure 11:
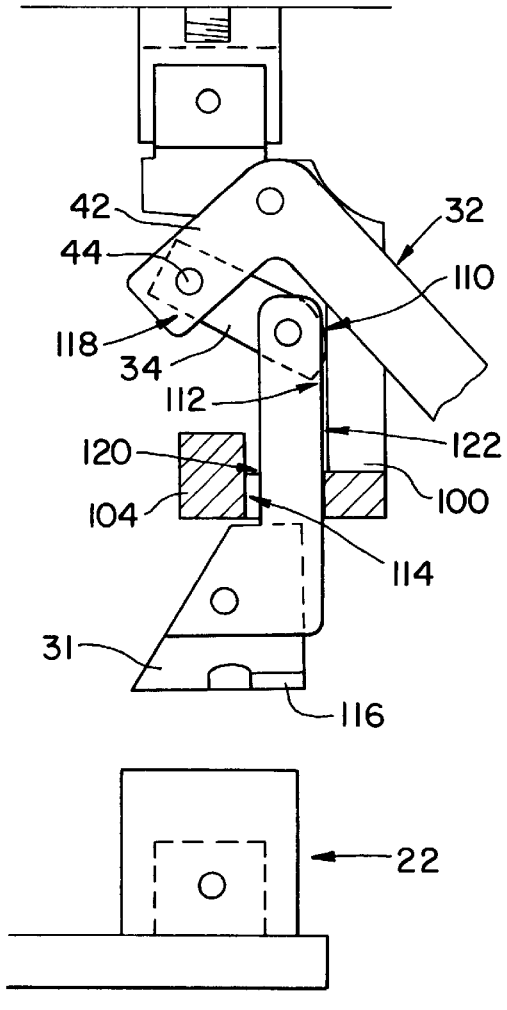
FIG. 11 is a lateral schematic view of the brake system of FIG. 1, illustrating the rocker arm encountering the transverse member.
Figure 12:
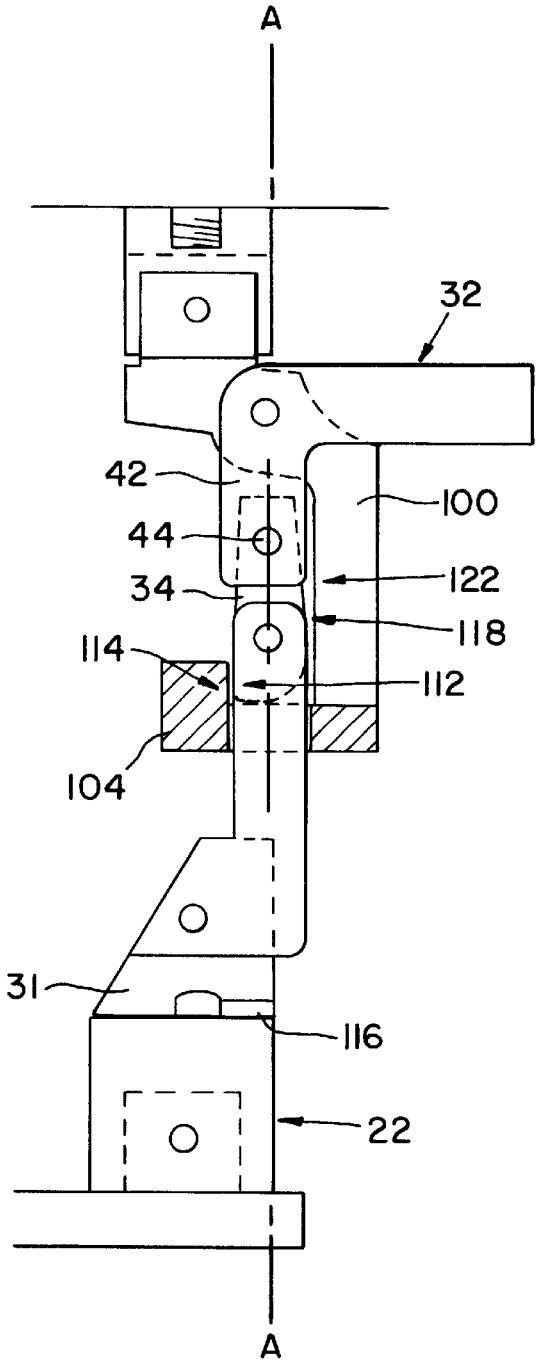
FIG. 12 is a lateral schematic view of the brake system of FIG. 1, illustrating the resilient pad of the anvil compressed against the lower jaw assembly before crossing the lower jaw assembly.
Figure 13:
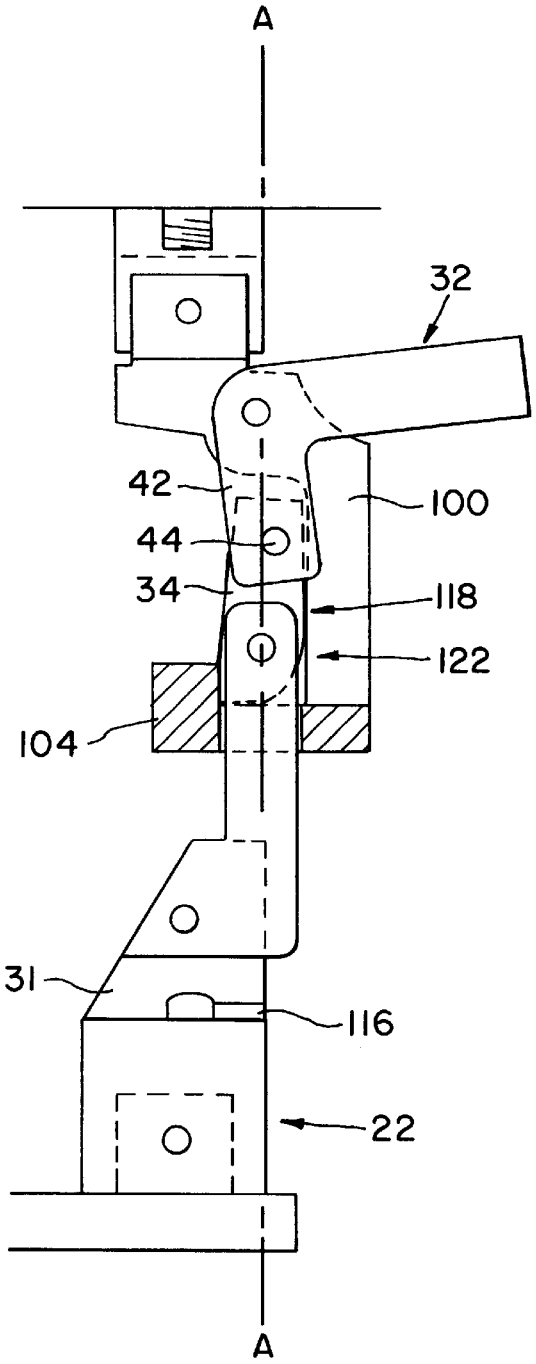
FIG. 13 is a lateral schematic view of the brake system of FIG. 1, illustrating the anvil engaging the lower jaw assembly as it travels past the line AA causing the movable jaw assembly to lock into position.

Referring now to FIGS. 6–8, there is shown bending member 62 in a series of upper, backside, and end views thereof. Bending member 62 is illustratively provided in the form of an elongate body 70 having at an upper side 72 thereof a laterally extending lip or ledge portion 74. In accordance with another aspect of the present invention, bending member 62 further includes a pair of projecting flange elements 76, 78 provided in the form of an arc-type structure that extends in a forward direction from an undersurface of lip portion 74 and projects away from the main body 70. The projecting flange elements 76, 78 define pivoting structures by which bending member 62 is hingedly associated with fixed jaw 60.

Referring again to FIG. 5, fixed jaw 60 further includes a pair of complementary mating grooves or channels 80, 82 respectively formed in guiding structures 66, 68. The illustrated channels 80, 82 are constructed in registered, complementary fashion to flange elements 76, 78 of bending member 62, such that flange elements 76, 78 can be slidingly received therein to fully establish the pivoting connection between fixed jaw 60 and bending member 62. In one form thereof, flange elements 76, 78 are curvilinear structures preferably defining a semicircular geometry. Likewise, mating grooves 80, 82 preferably define a semicircular geometry to permit interfitting registration with similarly-shaped flange elements 76, 78. Guiding structures 66, 68 are constructed to accommodate the pivoting motion of bending member 62 and to ensure that the upper surfaces of fixed law 60 and bending member 62 are substantially coplanar when bending member 62 is oriented in its non-pivoting state corresponding to an "at-rest" position. To accommodate lip portion 74, the guiding structures 66, 68 have a terraced form in which the upper level forms part of the clamping surface and the lower level is arranged to have lip portion 74 resting thereon during the "at-rest" condition. Grooves 80, 82 are exposed at both ends thereof to provide flange elements 76, 78 with point-of-entry access through either side of fixed jaw 60 depending upon whether a clamping or pressing arrangement is desired, as discussed below in further detail. Although only a pair of projecting flange elements 76, 78 is shown, this should not be considered as a limitation of the present invention as it should be apparent that the pivoting connection may be established with any number of suitable flange elements, as accompanied by the proper number of corresponding flange-guiding channels in fixed jaw 60.

Fixed jaw 60 and bending member 62 are integrally interfit with one another in their pivoting relationship by disposing the free ends 84, 86 of flange elements 76, 78 into the forward openings 88 of grooves 80, 82. In accordance with another aspect of the present invention, projecting flange elements 76, 78 are constructed and arranged with respect to fixed jaw 60 and bending member 62 such that when bending member 62 is positioned in its non-pivoting state relative to fixed jaw 60 (i.e., when the flange elements 76, 78 are fully interfit into their corresponding grooves 80, 82), no part of flange elements 76, 78 extends above the clamping plane defined at the upper surface of fixed jaw 60. It is also a feature of the present invention that no part of flange elements 76, 78 extends above the bending plane defined at the upper surface of bending member 62. Accordingly, flange elements 76, 78 provide a pivoting connection for bending member 62 relative to fixed jaw 60 that permits the formation of an unimpeded working space at the lower jaw assembly 22 in which there are no protrusions or obstructions into the working space during the "at-rest" condition. The presence of any such structural impediments would limit the ability of brake 10 to have sheet materials freely maneuvered into position over lower jaw assembly 22 from all different feed directions.

During the operation of brake 10 disclosed herein in which a sheet bending operation is executed, anvil 31 is brought into a press fit engagement with the workpiece material overlying lower jaw assembly 22, while bending member 62 is pivoted relative to fixed jaw 60 in a manner suitable to produce the desired bending of the workpiece material. Prior to the working activation of the jaw assemblies, movable jaw 24 has a placement corresponding to a non-clamping arrangement in which the attached anvil 31 is disposed in overlying spaced-apart relationship with respect to fixed jaw 60. FIG. 1 illustratively depicts such an arrangement. It is during this pre-working period that any necessary rotating adjustments are made with regard to the relative positioning of the jaw assemblies 20, 22 and "C"-shaped member 12. The sheet material of interest is then situated in overlying contacting relationship with respect to the upper surfaces of fixed jaw 60 and bending member 62. To initiate the clamping activity, lever mechanism 32 is pivoted upwardly to induce a pivoting action in rocker arm 34 that causes movable jaw 24 and anvil 31 to move in a downward direction towards lower jaw assembly 22, eventually bringing anvil 31 into facing engagement with the sheet material disposed thereon. FIGS. 2 and 3 illustratively depict such a clamping arrangement. Anvil 31 is locked into place by pivoting lever mechanism 32 past a vertical axis as discussed below in further detail.

The movement of movable jaw 24 is facilitated by certain guiding structures provided in frame section 46 of upper jaw assembly 20. Referring briefly to FIG. 1, frame section 46 further includes an integral, rigid backwall member 100 adapted for engagement with rocker arm 34 as rocker arm 34 is pivoted and eventually brought into locking contact with an inner vertical surface of rigid backwall member 100. Frame section 46 further includes integral, rigid transverse members 102, 104 each preferably disposed in a cross-wise direction extending across the transverse dimension of movable jaw 24. As shown, transverse member 102 is disposed at an inner side of upper jaw assembly 20 while transverse member 104 is disposed at an outer side thereof. Transverse members 102, 104 act cooperatively to define a guiding passage therebetween that facilitates the guiding of movable jaw 24 as it is reciprocated through its various working positions. The entirety of frame section 46, and in particular backwall member 100 and transverse members 102, 104, remain rigidly stationary during the working activity of the jaw assemblies. The role played by these frame section elements will become more apparent in the discussion below.

The locking action of anvil 31, in particular, is accomplished as follows in FIGS. 10–13. When the lever mechanism 32 is pivoted upwardly to induce a pivoting action in the rocker arm 34, the curved surface 110 of the rocker arm 34 in FIG. 11 encounters the inner vertical surface 122 of the rigid backwall member 100. As lever mechanism 32 is further pivoted upwardly in FIG. 12, the nose 112 of the rocker arm encounters the inner vertical surface 114 of the transverse member 104 causing the pivoting action of the rocker arm 34 to be impeded. As lever mechanism 32 is further pivoted upwardly, the resilient pad 116, located at an intermediate surface of the anvil 31 adjacent to the lower jaw assembly 22 and extending toward the extending link portions 40 and 42 until the end proximate of the anvil 31, is compressed and the pivot shaft or pin 44 is located to the left of line AA of FIG. 12. As the lever mechanism 32 is further pivoted upwardly, the outer bottom surface of the anvil 31 is pivoted in an orientation that engages the entire bottom surface of the anvil 31 to the lower jaw assembly 22 as the pivot shaft or pin 44 travels to the right of line AA of FIG. 13. The flat portion 118 of the rocker arm 34 now rests against the inner vertical surface 122 of the rigid backwall member 100, thus locking the mechanism.

It is a desirable feature of brake systems in general to maximize the opening between the anvil clamping surface and the fixed jaw clamping surface as material is being fed into the brake or removed from the brake. This objective is accomplished in brake 10 of the present invention by maximizing the horizontal displacement relative to line AA of the pivot point between rocker arm 34 and lever mechanism 32 when rocker arm 34 is in its open or unlocked position. In one such maximizing arrangement, rocker arm 34 would be pulled by suitable pivoting of lever mechanism 32 into a nearly horizontal position, which in turn elevates movable jaw 24 and its attached anvil 31 into a non-clamping position as far as possible from the normally fixed but rotatable jaw member 60.

The pivoting action of rocker arm 34 produces both vertical and horizontal displacement vectors that are exerted upon movable jaw 24, although transverse members 102, 104 of frame section 46 oppose any horizontal movements thereof and thereby constrain movable jaw 24 to its intended vertical travel. However, the existence of such influences in both directions tends to cause a binding of movable jaw 24 in the passageway defined by transverse frame members 102, 104. This tendency is overcome according to another aspect of the present invention in FIG. 10 by tapering or narrowing 120 the width of movable jaw 24 at its lower end, i.e., the tapering begins at an intermediate portion of the sidewalls 26, 28 thereof and extends to the end proximate anvil 31. Also, the rocker arm 34 is curved 110 along an intermediate portion of the upper surface of the rocker arm 34 and extending to an intermediate point of the inner surface of the rocker arm 34 when the opening is maximized between the anvil clamping surface and the fixed jaw clamping surface.

When anvil 31 is being lowered to reach its clamping position, it is important that movable jaw 24 be continuously oriented in an exactly registered spaced-apart relationship to fixed jaw 60. This registration is maintained as the vertical contact surfaces of sidewalls 26, 28 of movable jaw 24 are guided into and through transverse frame members 102, 104 while movable jaw 24 is being lowered.

Figure 9:
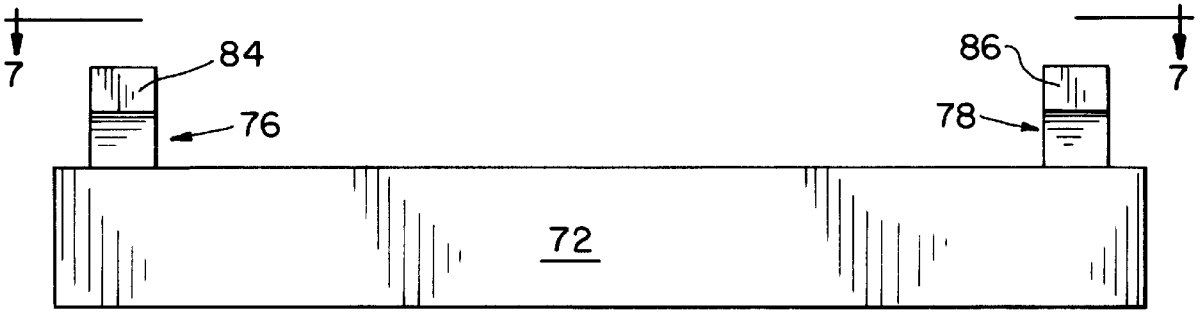
FIG. 9 is a lateral schematic view of the brake system of FIG. 1, as configured in a clamping state with bending activity occurring, illustrating how the flange elements facilitate the pivoting action of the bending member.

Referring now to FIG. 9, there is showing a lateral view of brake 10 illustrating a locked, clamping arrangement between upper jaw assembly 20 and lower jaw assembly 22 and an illustrative pivoting orientation of bending member 62 that facilitates the bending operation. Referring briefly to FIG. 1, it is a feature of the present invention that when fixed jaw 60 and bending member 62 are disposed in their "at-rest" orientation (i.e., bending member 62 is in a non-pivoted condition relative to fixed jaw 60), the semicircular projecting flange elements 76, 78 do not project above the upper surface plane of fixed jaw 60 nor do they project above the upper surface plane of the "at-rest" bending member 62. This enables material to be fed into brake 10 from the ends of lower jaw assembly 22 without any interference that otherwise would be present if the hinge structures extended into the working space. After the sheet metal material is secured in its pressed engagement between anvil 31 and the working plane defined at the upper surfaces of fixed jaw 60 and bending member 62, brake 10 is now prepared to execute a bending operation by appropriately pivoting bending member 62 to the pivot angle compatible with the desired degree of bend. Means (not shown) are provided in integral operative association with lower jaw assembly 22 to controllably activate the pivoting of bending member 62 and to securably position bending member 62 in the desired bending orientation while the sheet material is suitably reshaped.

In regard to the manufacturing of the brake parts described herein, it is preferred that each of the elements is cast or molded as unitary structures. Additionally, bending member 62 with its semicircular projecting flange elements is preferably formed as a unitary structure, although the flange elements may be separately formed and then integrally attached to bending member 62 at the appropriate locations. Furthermore, guiding structures 66, 68 with their flange-receiving grooves may be separately formed and then integrally attached to fixed jaw 60. The working edge of the anvil may have a steel insert bolted or riveted to the anvil body.

The bearing surfaces of the semicircular hinge may have any one of a number of hardened low-friction materials bonded or riveted to the mating surfaces to ease the guided pivoting of the projecting flange elements within their corresponding semicircular channels.

What has been shown and described herein is a brake system enabling adjustments to be made to the relative positioning of the upper and lower jaw assemblies 20, 22 and "C"-shaped member 12 through controlled rotary movements of either the jaw assemblies or "C"-shaped member 12 or both. The orientation of these brake units is adjustable in a manner that permits brake 10 to be employed in front feed, back feed, and end feed applications. Accordingly, the slots for receiving the removable pins that free the jaw assemblies for rotation are preferably formed in 90 degree increments to permit a full 360 degree range of motion. The orientation of the upper jaw assembly 20 components to the lower jaw assembly 22 components is maintained at each of the repositioning locations because their respective axes of rotation are parallel, and, in a preferred form thereof are coincident with one another. Specifically, the orientation of the integral frame section 46, movable jaw 24, and anvil 31 relative to the integral fixed jaw 60 with its hingedly attached bending member 62 is precisely reproducible as the jaw assemblies are each repositioned to their new rotary location.

This rotational repositioning permits brake 10 to be adapted to nearly any field condition through appropriate changes in the orientation of the jaw assemblies and "C"-shaped member 12, allowing the operator to manipulate existing ductwork, fabricate original ductwork at the job site, and/or integrate the brake with other compatible equipment to produce a unit having tandem operating capabilities.

In the illustrative embodiments disclosed herein, the rotational coupling between the jaw assemblies and the frame structure (i.e., "C"-shaped member 12) is realized by an adjustable hub-socket arrangement that uses a removable pin to secure the parts together after completion of the desired rotary repositioning. However, this particular form of connection is merely illustrative and should not be considered a limitation of the present invention. Rather, the present invention encompasses any coupling arrangement or connection feature that proposes in function to permit the jaw assemblies and frame structure to be repositioned with respect to one another through adjustments in their rotary orientations. Additionally, the manner of displacing movable jaw member 24 is not limited to the illustrated lever mechanism 32 and lockable rocker arm 34 but instead encompasses any means that proposes in function to be able to controllably displace movable jaw member 24.

In accordance with another aspect of the present invention, the jaw assemblies can be transformed into a press arrangement to accommodate other useful job site tasks by removing bending member 62 from its pivoting registration with fixed jaw 60, rotating it 180 degrees, and then re-integrating it with fixed jaw 60 by inserting the free ends of the projecting flange elements into the other groove ends opposite those from which the flange elements were just removed. This re-configuration creates a press arrangement to which various dies may be affixed to form a rolled edge or bead, for example.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A sheet bending brake, comprising:

a frame;

a fixed jaw rotatingly adjustably coupled to said frame at one portion thereof;

a movable jaw rotatingly adjustably coupled to said frame at another portion thereof, said movable jaw being movable relative to said fixed jaw in at least one of a clamping and non-clamping arrangement therewith;

an anvil member secured to said movable jaw; and a bending member hingedly associated with said fixed jaw.

2. The sheet bending brake as recited in claim 1, wherein said bending member further comprises:

at least one hinging projection adjustably received within a respective complementary channel integrally associated with said fixed jaw.

3. The sheet bending brake as recited in claim 2, wherein said at least one hinging projection being characterized such that during a non-pivoting condition of said bending member, no part of said at least one hinging projection extends above a clamping plane defined at an upper surface of said fixed jaw.

4. The sheet bending brake as recited in claim 3, wherein each respective one of said at least one hinging projection further comprises:

a structure defining, at least in part, an arc shape.

5. The sheet bending brake as recited in claim 4, wherein each of said structures defining at least in part an arc shape further includes a substantially semicircular portion.

6. The sheet bending brake as recited in claim 5, wherein each of said complementary channels associated with said fixed jaw defines, at least in part, a substantially semicircular portion.

7. The sheet bending brake as recited in claim 6, wherein:

said bending member being configurable with said fixed jaw in a sheet bending arrangement when said at least one hinging projection of said bending member being adjustably disposed within the respective complementary channel associated with said fixed jaw from a first end thereof; and said bending member being configurable with said fixed jaw in a sheet pressing arrangement when said at least one hinging projection of said bending member being adjustably disposed within the respective complementary channel associated with said fixed jaw from a second end thereof.

8. The sheet bending brake as recited in claim 2, wherein said frame further comprises:

an upper arm and a lower arm in spaced-apart relation; and a connecting body connected at respective ends thereof to said upper arm and said lower arm.

9. The sheet bending brake as recited in claim 8, further comprises:

a socket member integrally associated with said upper arm and extending towards said lower arm;

a cylindrical hub integrally associated with said movable jaw and rotatingly adjustably disposed within the socket member integrally associated with said upper arm and secured therein using a removable pin;

a cylindrical hub integrally associated with said lower arm and extending towards said upper arm; and a socket member integrally associated with said fixed jaw and rotatingly adjustably disposed about the cylindrical hub integrally associated with said lower arm and secured thereabout using a removable pin.

10. The sheet bending brake as recited in claim 2, further comprises:

a rocker link pivotingly coupled at one end thereof to said movable jaw; and actuator means, pivotingly coupled to said rocker link at another end thereof, for inducing a pivoting action of said rocker link to effect movement of said movable jaw.

11. The sheet bending brake as recited in claim 10, wherein said actuator means comprises:

a lever member having a pair of spaced-apart extending link arms, said pair of extending link arms defining at one end thereof the fulcrum point for said lever member and defining at another end thereof a pivoting connection with said rocker link.

12. The sheet bending brake as recited in claim 8, wherein the arrangement of said connecting body, said upper arm, and said lower arm of said frame defines a generally C-shaped structure.

13. The sheet bending brake as recited in claim 1, wherein:

said fixed jaw including at least two pivot guiding channels formed therein, each respective one of said at least two pivot guiding channels being defined at least in part within a respective projecting portion of said fixed jaw; and said bending member including at least two hinging projections each adjustably disposed within a respective one of said at least two pivot guiding channels formed in said fixed jaw.

14. The sheet bending brake as recited in claim 13, wherein said fixed jaw further comprises:

a body portion; and a pair of pivot guiding structures integrally provided with said body portion at respective ends thereof and each having a respective projecting portion;

each respective one of said pair of pivot guiding structures having an associated one of said at least two pivot guiding channels formed therein;

each respective one of said at least two pivot guiding channels associated with said pair of pivot guiding structures being provided at least in part within the projecting portion of the respective pivot guiding structure associated therewith.

15. The sheet bending brake as recited in claim 14, wherein said bending member further comprises:

a body portion having a pair of lip members disposed at respective ends thereof;

wherein each respective one of said pair of lip members having a respective one of said at least two hinging projections extending therefrom at an underside thereof.

16. The sheet bending brake as recited in claim 15, wherein each respective one of said pair of pivot guiding structures of said fixed jaw being provided in a manner sufficient to enable each one of said pair of lip members of said bending member, during a non-pivoting condition of said bending member, to overlie a corresponding one of said pair of pivot guiding structures such that no part thereof extends above a clamping plane defined by said fixed jaw.

17. A sheet bending brake, comprising:

a frame;

a first jaw assembly integrally associated with said frame and being adapted to enable rotational adjustments to the relative positioning therebetween;

a second jaw assembly integrally associated with said frame and being adapted to enable rotational adjustments to the relative positioning therebetween, said second jaw assembly including a movable jaw member being controllably movable with respect to said first jaw assembly;

an anvil member secured to said movable jaw member; and a bending member arranged for adjustable pivoting with respect to said first jaw assembly.

18. The sheet bending brake as recited in claim 17, wherein said bending member further comprises:

at least two projection elements each extending from a body of said bending member and being adjustably positioned within a respective complementary channel provided in said first jaw assembly.

19. The sheet bending brake as recited in claim 18, wherein:

each of said at least two projection elements of said bending member including a substantially semicircular portion; and each of said complementary channels provided in said first jaw assembly including a substantially semicircular portion.

20. The sheet bending brake as recited in claim 19, wherein:

said first jaw assembly further including:

a socket member rotatingly adjustably disposed about a cylindrical hub integrally associated with said frame; and said second jaw assembly further including:

a cylindrical hub rotatingly adjustably disposed within a socket member integrally associated with said frame.

21. The sheet bending brake as recited in claim 18, wherein said second jaw assembly further comprises:

a rocker link pivotingly coupled at one end thereof to said movable jaw member; and means, pivotingly coupled to said rocker link at another end thereof, for inducing a pivoting action of said rocker link effective in moving said movable jaw member.

22. The sheet bending brake as recited in claim 21, wherein said means for inducing a pivoting action of said rocker link further comprises:

a lever member having a pair of spaced-apart extending link sections, said pair of extending link sections defining at one end thereof the fulcrum point for said lever member and defining at another end thereof a pivoting connection with said rocker link.

23. The sheet bending brake as recited in claim 18, wherein when said bending member is arranged in a non-pivoting orientation with respect to said first jaw assembly, said at least two projection elements of said bending member being characterized such that no part thereof extends above a clamping plane defined by said first jaw assembly.

24. The sheet bending brake as recited in claim 17, wherein:

said first jaw assembly including at least two pivot guiding channels formed therein, each respective one of said at least two pivot guiding channels being defined at least in part within a respective projecting portion of said first jaw assembly; and said bending member including at least two projection elements each adjustably disposed within a respective one of said at least two pivot guiding channels formed in said first jaw assembly.

25. The sheet bending brake as recited in claim 24, wherein said first jaw assembly further comprises:

a body portion; and a pair of pivot guiding structures integrally provided with said body portion at respective ends thereof and each having a respective projecting portion;

each respective one of said pair of pivot guiding structures having an associated one of said at least two pivot guiding channels formed therein;

each respective one of said at least two pivot guiding channels associated with said pair of pivot guiding structures being provided at least in part within the projecting portion of the respective pivot guiding structure associated therewith.

26. The sheet bending brake as recited in claim 25, wherein said bending member further comprises:

a body portion having a pair of lip members disposed at respective ends thereof;

wherein each respective one of said pair of lip members having a respective one of said at least two projection elements extending therefrom at an underside thereof.

27. The sheet bending brake as recited in claim 26, wherein each respective one of said pair of pivot guiding structures of said first jaw assembly being provided in a manner sufficient to enable each one of said pair of lip members of said bending member, during a non-pivoting condition of said bending member, to overlie a corresponding one of said pair of pivot guiding structures such that no part thereof extends above a clamping plane defined by said first jaw assembly.

28. A sheet bending brake, comprising:

a frame;

a fixed jaw rotatingly adjustably secured to said frame;

a movable jaw rotatingly adjustably secured to said frame, said movable jaw being controllably movable with respect to said fixed jaw;

an anvil member secured to said movable jaw; and a bending member pivotingly associated with said fixed jaw;

said bending member including at least two projecting flange elements each adjustably disposed within a respective complementary channel integrally associated with said fixed jaw.

29. The sheet bending brake as recited in claim 28, wherein:

each of said at least two projecting flange elements including a curvilinear portion; and each of said complementary channels integrally associated with said fixed jaw including a curvilinear portion.

30. The sheet bending brake as recited in claim 29, wherein:

the curvilinear portion of each of said at least two projecting flange elements defining, at least in part, a substantially semicircular shape; and the curvilinear portion of each of said complementary channels integrally associated with said fixed jaw defining, at least in part, a substantially semicircular shape.

31. The sheet bending brake as recited in claim 29, wherein said frame further comprises:

a generally C-shaped structure including an upper arm, a lower arm in spaced-apart relation to said upper arm, and a connecting body connected at respective ends thereof to said upper arm and said lower arm.

32. The sheet bending brake as recited in claim 31, further comprises:

a socket member integrally associated with said upper arm and extending towards said lower arm;

a cylindrical hub integrally associated with said movable jaw and rotatingly adjustably disposed within the socket member integrally associated with said upper arm;

a cylindrical hub integrally associated with said lower arm and extending towards said upper arm; and a socket member integrally associated with said fixed jaw and rotatingly adjustably disposed about the cylindrical hub integrally associated with said lower arm.

33. The sheet bending brake as recited in claim 28, further comprises:

a rocker link pivotingly coupled at one end thereof to said movable jaw; and a lever mechanism having a pair of spaced-apart extending link arms, said pair of extending link arms defining at one end thereof the fulcrum point for said lever mechanism and defining at another end thereof a pivoting connection with said rocker link.

34. The sheet bending brake as recited in claim 33, wherein said anvil further comprises:

a resilient pad located at an intermediate surface of said anvil adjacent to said fixed jaw and extending toward said pair of extending link arms until the end proximate of said anvil.

35. The sheet bending brake as recited in claim 28, wherein: when said bending member is oriented in a non-pivoting condition with respect to said fixed jaw, said at least two projecting flange elements being characterized such that no part thereof extends above a clamping plane defined by said fixed jaw.

36. The sheet bending brake as recited in claim 28, wherein:

said bending member being configurable with said fixed jaw in a sheet bending arrangement when said at least two projecting flange elements are adjustably disposed within the complementary channels integrally associated with said fixed jaw from first ends thereof; and said bending member being configurable with said fixed jaw in a sheet pressing arrangement when said at least two projecting flange elements are adjustably disposed within the complementary channels integrally associated with said fixed jaw from second ends thereof.

37. The sheet bending brake as recited in claim 36, wherein:

each of said at least two projecting flange elements including a curvilinear portion; and each of said complementary channels integrally associated with said fixed jaw including a curvilinear portion.

38. In a sheet bending brake comprising a frame, a fixed jaw integrally associated with said frame, a movable jaw integrally associated with said frame and controllably movable relative to said fixed jaw, and an anvil member secured to said movable jaw, said sheet bending brake further comprising:

a bending member pivotingly associated with said fixed jaw;

said fixed jaw including at least two operatively stationary pivot guiding channels formed therein, each respective one of said at least two operatively stationary pivot guiding channels being defined at least in part within a respective projecting portion of said fixed jaw; and said bending member including at least two projecting flange elements each adjustably disposed and insertably received within a respective one of said at least two operatively stationary pivot guiding channels formed in said fixed jaw so that each pivot guiding channel substantially surrounds each projection flange element.

39. The sheet bending brake as recited in claim 30, wherein:

each of said at least two projecting flange elements including a curvilinear portion; and each of said at least two pivot guiding channels formed in said fixed jaw including a curvilinear portion.

40. The sheet bending brake as recited in claim 39, wherein:

the curvilinear portion of each of said at least two projecting flange elements defining, at least in part, a substantially semicircular shape; and the curvilinear portion of each of said at least two pivot guiding channels formed in said fixed jaw defining, at least in part, a substantially semicircular shape.

41. The sheet bending brake as recited in claim 39, wherein when said bending member is oriented in a non-pivoting condition with respect to said fixed jaw, said at least two projecting flange elements being characterized such that no part thereof extends above a clamping plane defined by said fixed jaw.

42. The sheet bending brake as recited in claim 41, wherein:

said bending member being configurable with said fixed jaw in a sheet bending arrangement when said at least two projecting flange elements are adjustably disposed within respective ones of said at least two pivot guiding channels from first ends thereof; and said bending member being configurable with said fixed jaw in a sheet pressing arrangement when said at least two projecting flange elements are adjustably disposed within respective ones of said at least two pivot guiding channels from second ends thereof.

43. The sheet bending brake as recited in claim 38, wherein:

said fixed jaw being rotatingly adjustably secured to said frame; and said movable jaw being rotatingly adjustably secured to said frame.

44. The sheet bending brake as recited in claim 38, wherein said fixed jaw further comprises:

a body portion; and a pair of pivot guiding structures integrally provided with said body portion at respective ends thereof and each having a respective projecting portion;

each respective one of said pair of pivot guiding structures having an associated one of said at least two pivot guiding channels formed therein;

each respective one of said at least two pivot guiding channels associated with said pair of pivot guiding structures being provided at least in part within the projecting portion of the respective pivot guiding structure associated therewith.

45. The sheet bending brake as recited in claim 44, wherein said bending member further comprises:

a body portion having a pair of lip members disposed at respective ends thereof;

wherein each respective one of said pair of lip members having a respective one of said at least two projecting flange elements extending therefrom at an underside thereof.

46. The sheet bending brake as recited in claim 45, wherein each respective one of said pair of pivot guiding structures of said fixed jaw being provided in a manner sufficient to enable each one of said pair of lip members of said bending member, during a non-pivoting condition of said bending member, to overlie a corresponding one of said pair of pivot guiding structures such that no part thereof extends above a clamping plane defined by said fixed jaw.

* * * * *